US012291830B2

(12) United States Patent
Moody et al.

(10) Patent No.: US 12,291,830 B2
(45) **Date of Patent: *May 6, 2025**

(54) SYSTEM AND METHOD FOR MITIGATION OF LIQUEFACTION

(71) Applicant: Independence Materials Group, LLC, Virginia Beach, VA (US)

(72) Inventors: Donald James Moody, Ontario, CA (US); Cliff Frazao, Ontario, CA (US)

(73) Assignee: Independence Materials Group, LLC, Virginia Beach, VA (US)

( * ) Notice: Subject to any disclaimer, the term of this patent is extended or adjusted under 35 U.S.C. 154(b) by 251 days.

This patent is subject to a terminal disclaimer.

(21) Appl. No.: 18/052,836

(22) Filed: Nov. 4, 2022

(65) Prior Publication Data

US 2023/0101871 A1 Mar. 30, 2023

Related U.S. Application Data

(63) Continuation of application No. 16/823,258, filed on Mar. 18, 2020, now Pat. No. 11,525,230.

(60) Provisional application No. 62/820,778, filed on Mar. 19, 2019.

(51) Int. Cl.
*E02D 27/34* (2006.01)
*E02D 3/12* (2006.01)

(52) U.S. Cl.
CPC ..... *E02D 3/12* (2013.01); *E02D 27/34* (2013.01); *E02D 2250/003* (2013.01); *E02D 2300/0014* (2013.01)

(58) Field of Classification Search
CPC ..... E02D 3/12; E02D 2250/003; E02D 2300/0014; E02D 35/00; E02D 5/46
See application file for complete search history.

(56) References Cited

U.S. PATENT DOCUMENTS

| | | | |
|---|---|---|---|
| 695,583 | A | 3/1902 | Schietkiewics |
| 1,952,162 | A | 3/1934 | Anthony |
| 2,196,211 | A | 4/1940 | Hartman |
| 2,232,898 | A | 2/1941 | Ackley |
| 2,627,169 | A | 2/1953 | Poulter |
| 4,567,708 | A | 2/1986 | Haekkinen |
| 5,819,850 | A | 10/1998 | Lee et al. |
| 5,934,836 | A | 8/1999 | Rupiper et al. |
| 6,634,831 | B2 | 10/2003 | Canteri |
| 6,821,056 | B1 | 11/2004 | Mansour |
| 7,338,232 | B2 | 3/2008 | Nasr |
| 7,789,591 | B2 | 9/2010 | Häkkinen et al. |
| 8,956,083 | B2 | 2/2015 | Häkkinen et al. |
| 9,551,126 | B1 | 1/2017 | Schmall |
| 10,465,355 | B2 | 11/2019 | Barron et al. |
| 2002/0098042 | A1 | 7/2002 | Canteri |
| 2003/0121654 | A1 | 7/2003 | Carlin |
| 2006/0013658 | A1 | 1/2006 | Erdemgil |
| 2013/0129423 | A1 | 5/2013 | Häkkinen et al. |
| 2016/0017562 | A1 | 1/2016 | Barron et al. |
| 2016/0312429 | A1 | 10/2016 | Arima et al. |
| 2016/0362901 | A1 | 12/2016 | Tabatabai |
| 2017/0073919 | A1 | 3/2017 | Barron et al. |

(Continued)

*Primary Examiner* — Benjamin F Fiorello
(74) *Attorney, Agent, or Firm* — Moore & Van Allen PLLC; Jeffrey R. Gray

(57) ABSTRACT

A method for the reduction of liquefaction potential within soil of a stratum located a distance deep below a foundation of a structure through the injection of a two-part polyurethane liquid forming a polymer foam.

20 Claims, 8 Drawing Sheets

(56) References Cited

U.S. PATENT DOCUMENTS

| | | | |
|---|---|---|---|
| 2019/0186095 | A1 | 6/2019 | Eddie et al. |
| 2020/0190760 | A1 | 6/2020 | Pastor et al. |

SYSTEM AND METHOD FOR MITIGATION OF LIQUEFACTION

CROSS-REFERENCE TO RELATED APPLICATION

This application is a continuation application of U.S. patent application Ser. No. 16/823,258, filed Mar. 18, 2020, which claims benefit under 35 U.S.C. § 119(e) to U.S. Provisional Patent App. No. 62/820,778, filed Mar. 19, 2019, the entire disclosures of which are hereby incorporated by reference herein in their entireties. Any and all priority claims identified in the Application Data Sheet, or any corrections thereto, are hereby incorporated by reference under 37 CFR § 1.57.

BACKGROUND

Field

This disclosure relates to systems and methods for the remediation of soil subject to liquefaction.

Description of the Related Art

Structures (e.g., buildings, roads, dams, etc.) require a solid foundation on soil with a sufficient bearing capacity. Loose soil can liquefy and lose its bearing capacity under seismic loads in a phenomenon called liquefaction. The instability created by liquefaction can create instability in the soil that causes the structures to shift or move. The movement can cause buried structures to move in an upward or downward direction. Severe structural damage can be the result.

Liquefaction occurs in sandy or loose soil strata that are saturated with water. Under a seismic load (e.g., shear stress), the loose soil settles or condenses. The settling loose soil causes an increase in the pore pressure of the water contained within the loose soil. The increased pore pressure lowers the contact pressure between grains of the loose soil until the loose soil is essentially liquefied. As a liquid, the strata provide little support for upper layers of the soil, as may contain slopes or structures.

Various treatments for preventing liquefaction exist. One method is to remove the loose soil material and replace it with compact soil material. This can be a prohibitively expensive and time-consuming process, especially where the loose soil is deep and/or the water table is high. Another approach is to densify the loose material by various compaction methods at the surface (e.g., dropping of heavy weights onto the surface, vibrational compaction, etc.). This approach can be of limited use where the overall depth of the loose soil is deeper than the effective zone of compaction.

In another common treatment, pilings are driven through the loose soil to compact the loose soil around the pilings. The pilings can also extend through the loose soil stratum and contact a deeper, more compact soil stratum. Pilings are not always suitable, depending on the relative compaction of the soil and/or the depth of the loose soil stratum. Moreover, during a liquefaction event, the pilings extending within the loose soil stratum can be left without lateral support.

In another treatment, French drains can be provided to create paths through which the water contained within the saturated loose soil can escape when the water pressure is raised. The French drains can take the form of holes having diameters of 3 to 5 feet that have been dug into the loose soil stratum and are filled with gravel or sand. These drainages can still fail to provide adequate means of escape for the excess water pressure that builds up very quickly during a seismic event.

In another treatment, an expanding resin is injected into the loose soil. The resin fills the voids in the soil and then begins to expand, compacting the existing soil to stabilize a hillside or a wall of an excavated pit. The expansive resin can be injected through a pipe comprising holes in its walls, whereby the resin can also penetrate into the soil through the walls of the pipe. However, existing equipment and techniques for delivering the resin into the soil are limited, prone to malfunction and clogging, and provide insufficient feedback during the installation process to gauge success of the technique. Accordingly, improved equipment and techniques are needed.

SUMMARY

The embodiments disclosed herein each have several aspects no single one of which is solely responsible for the disclosure's desirable attributes. Without limiting the scope of this disclosure, its more prominent features will be briefly discussed. After considering this discussion, and particularly after reading the section entitled "Detailed Description Of Innovative Method and Equipment," one will understand how the features of the embodiments described herein provide advantages over existing systems, devices, and methods.

The following disclosure describes non-limiting examples of some embodiments. For instance, other embodiments of the disclosed systems and methods may or may not include the features described herein. Moreover, disclosed advantages and benefits can apply only to certain embodiments of the invention and should not be used to limit the disclosure.

One aspect of the disclosure is a method for the reduction of liquefaction potential within soil of a stratum located deep below a foundation of a structure. The method includes determining a distance from the foundation to the stratum and a thickness of the stratum and providing a plurality of injectors. Each injector of the plurality of injectors has a hollow shape over a proximal portion and a distal portion. The proximal portion has a solid outer wall and a length generally corresponding to the distance from the foundation. The distal portion has a perforated outer wall and a length generally corresponding to the thickness of the stratum. The method further includes selecting a spacing distance for drilling a plurality of holes through the foundation and determining a zone of influence based on the selected spacing distance. The method further includes determining an amount of a two-part polyurethane liquid for injecting into the stratum based on the determined zone of influence, drilling the plurality of holes through the foundation at the selected spacing distance, drilling in the plurality of holes and through the soil with the plurality of injectors, locating the distal portion of each injector within the stratum, injecting the predetermined amount of the two-part polyurethane liquid down each of the plurality of injectors and into the stratum via the perforated outer wall of the distal portion, permeating the stratum with the injected two-part polyurethane liquid while the two-part polyurethane liquid reacts forming a tacky foam, the tacky foam displacing water and binding to the soil within the stratum, and slowly curing the tacky foam to form a solid foam matrix comprising particles of the soil within the stratum.

According to another aspect, the stratum comprises loose sand.

According to another aspect, the soil comprises a second stratum disposed above the stratum. The second stratum comprises sand having a higher density than sand in the stratum.

According to another aspect, the perforated outer wall comprises a plurality of openings. The plurality of openings are covered by a plurality of corresponding flaps when the plurality of injectors are drilled into the soil.

According to another aspect, the spacing distance is 3 feet on center.

According to another aspect, the zone of influence is 4 feet.

According to another aspect, the solid foam matrix is contained within the zone of influence.

According to another aspect, the amount of the two-part polyurethane liquid is between 40-50 lbs. for each injector of the plurality of injectors.

Another aspect of the disclosure is a method for the reduction of liquefaction potential within soil of a loose stratum having a thickness and being located a distance below a surface. The method comprises providing a plurality of injectors. Each injector of the plurality of injectors has a proximal portion and a distal portion. The distal portion has a perforated outer wall. The method further includes inserting the plurality of injectors within the soil and locating the distal portion of each injector within the loose stratum. The method further includes injecting a two-part polymer liquid down each of the plurality of injectors and into the loose stratum via the perforated outer wall of the distal portion so that the liquid permeates the loose stratum forming a tacky foam which slowly cures to a solid foam matrix comprising particles of the soil within the loose stratum.

According to another aspect, the proximal portion has a solid outer wall and a length generally corresponding to the distance below the surface, and wherein the distal portion has a length generally corresponding to the thickness of the loose stratum.

According to another aspect, the distance is 15 feet and the thickness of the stratum is 15 feet.

According to another aspect, the length of the distal portion is 15 feet.

According to another aspect, the length of the proximal portion is 15 feet.

According to another aspect, the plurality of injectors form a grid pattern across a surface of the foundation.

According to another aspect, the method further comprises ceasing injection of the two-part polymer liquid when an upper surface of the soil reaches a visible heave point.

Another aspect of the disclosure is a system for reinforcing a loose soil stratum with increased liquefaction potential. The system comprises a plurality of injectors, each injector including: a proximal portion having a hollow shape and a solid outer wall, the proximal portion having a sufficient length to span from a ground surface to the loose soil stratum, and a hollow distal portion coupled to the proximal portion and having a perforated outer wall, the hollow distal portion having a length relating to a thickness of the loose soil stratum. The system further comprises a device configured for driving the injector into the loose soil stratum and an injection system. The injection system includes an injection nozzle configured to couple with an upper end of each of the plurality of injectors, a pump coupled with the injection nozzle and configured to pump a liquid polymer, and a storage reservoir for the liquid polymer. When in use the plurality of injectors are inserted within the loose soil stratum using the device and the injection system pumps the liquid polymer into the loose soil stratum through the injectors. The liquid polymer exits the perforated outer wall of the hollow distal portions of the injectors. The liquid polymer hardens into foam veins configured to displace water from within the loose soil stratum.

According to another aspect, the distal portion has a length generally corresponding to the thickness of the loose soil stratum.

According to another aspect, each injector of the plurality of injectors includes a zone of influence, the foam veins disposed within respective zones of influence.

Another aspect of the disclosure is a method for the reduction of liquefaction potential within soil of a stratum located a distance deep below a foundation of a structure. The stratum has a thickness. The method comprises providing a plurality of injectors, each injector of the plurality of injectors having a hollow shape over a proximal portion and a distal portion, the proximal portion having a solid outer wall and a length generally corresponding to the distance below the foundation. The distal portion has a perforated outer wall and a length generally corresponding to the thickness of the stratum. The perforated outer wall comprises a first plurality of openings and a second plurality of openings. The second plurality of openings is offset along the length of the distal portion from the first plurality of openings. The method further comprises drilling the plurality of injectors through the soil below the foundation, locating the distal portion of each injector within the stratum, and injecting a two-part polyurethane liquid down each of the plurality of injectors and into the stratum via the perforated outer wall of the distal portion. The method further comprises permeating the stratum by the injected two-part polyurethane liquid while the two-part polyurethane liquid reacts forming a tacky foam, the tacky foam displacing water and binding to the soil within the stratum. The method further comprises slowly curing the tacky foam to form a solid foam matrix surrounding each of the injectors, each solid foam matrix having a hub structure parallel to the injector and coupled to a plurality of stacked spoke structures via the first plurality of openings and the second plurality of openings, each hub structure being reinforced by at least a portion of the distal portion of its respective injector.

According to another aspect, permeating the stratum by the injected two-part polyurethane liquid includes injecting the two-part polyurethane liquid into the stratum until a surface of the stratum reaches a visible heave point.

One aspect of the disclosure is a method for the reduction of liquefaction potential within soil of a loose stratum located a distance below a surface. A plurality of injectors including a proximal portion and a distal portion. The proximal portion has a solid outer wall and a length generally corresponding to the distance below the surface. The distal portion has a perforated outer wall and a length generally corresponding to the thickness of the stratum. The plurality of injectors are placed within the soil using a pile hammer. The distal portions of each injector are located in the loose stratum. A two-part polymer liquid is injected down each of the plurality of injectors and into the loose stratum via a perforated outer wall of the distal portion. The liquid permeates the loose stratum forming a tacky foam which slowly cures to a solid foam matrix comprising particles of the soil within the stratum.

According to another aspect, injection of the two-part polymer liquid continues until an upper surface of the soil reaches a visible heave point.

According to another aspect, injection of the two-part polymer foam into the injectors proceeds from an innermost injector to an outermost injector.

One aspect of the disclosure is a method of assembling a plurality of injectors for injecting a predetermined amount of a two-part polyurethane liquid into a stratum located a distance deep below a foundation of a structure. The stratum has a thickness of soil with increased liquefaction potential. Each injector of the plurality of injectors comprises a proximal portion having a length generally corresponding to the distance and a distal portion having a length generally corresponding to the thickness. The method further comprises coupling a first plurality of segments end to end to form the distal portion. Each segment of the first plurality of segments is hollow and has a perforated outer wall covered by a plurality of flaps. The method further includes coupling a second plurality of segments end to end to form the proximal portion, each segment of the second plurality of segments being hollow and having a solid outer wall, coupling the distal portion to the proximal portion so that when the distal portion of each injector of the plurality of injectors is located in the stratum the predetermined amount of the two-part polyurethane liquid permeates the stratum displacing water and slowly cures to form a solid foam matrix comprising particles of the soil within the stratum. The method further includes injecting the two-part polyurethane liquid into the stratum until a surface of the stratum reaches a visible heave point.

BRIEF DESCRIPTION OF DRAWINGS

The foregoing and other features of the present disclosure will become more fully apparent from the following description and appended claims, taken in conjunction with the accompanying drawings. Understanding that these drawings depict only several embodiments in accordance with the disclosure and are not considered limiting of its scope, the disclosure will be described with additional specificity and detail through use of the accompanying drawings. In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the drawing, can be arranged, substituted, combined, and designed in a wide variety of different configurations, all of which are explicitly contemplated and make part of this disclosure.

DETAILED DESCRIPTION OF INNOVATIVE METHOD AND EQUIPMENT

Figure 1A:
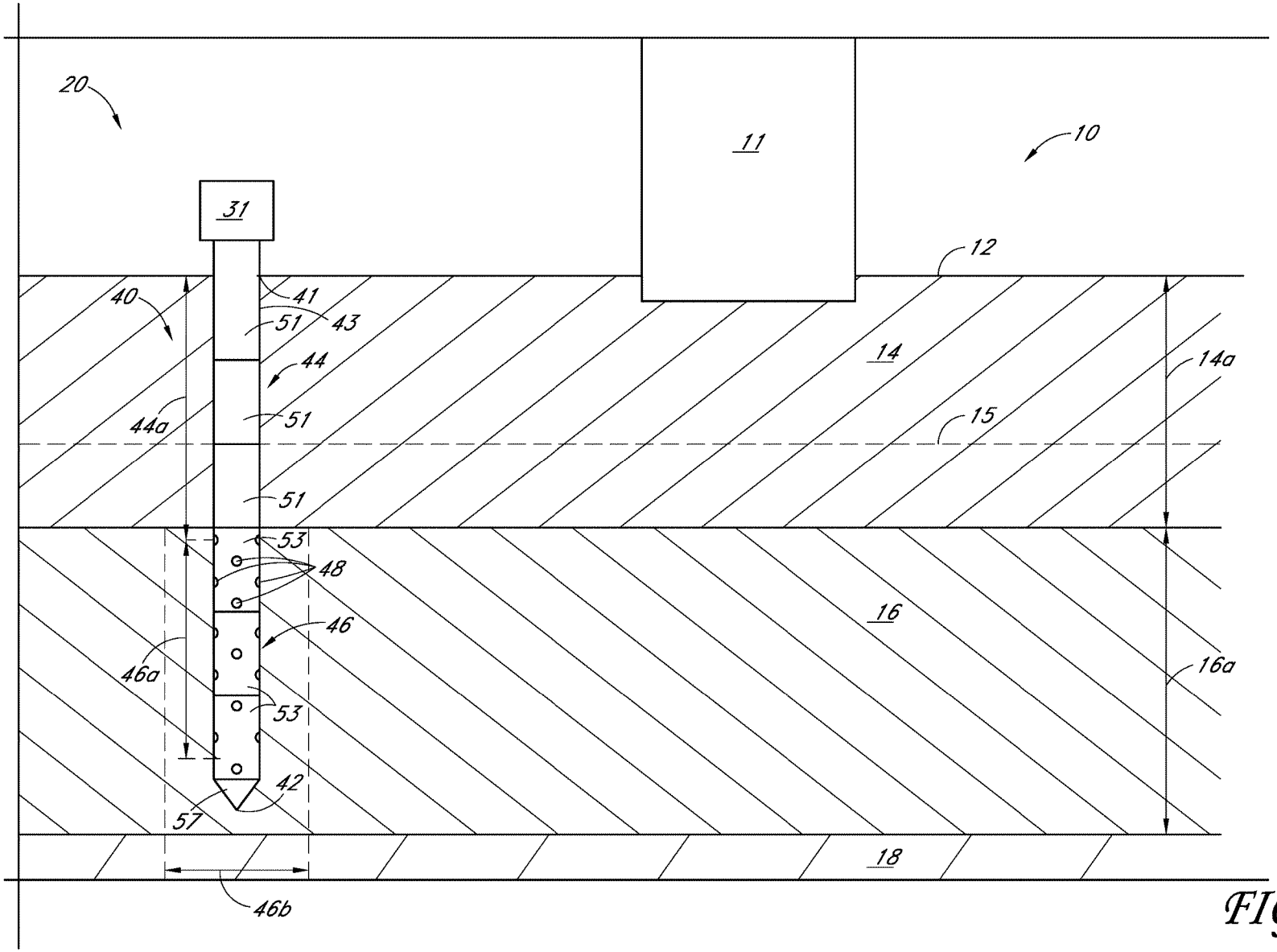
FIG. 1A is a section view of a structure supported on a subsoil that includes a loose stratum and shows an exemplary injector of an injection system penetrating the subsoil adjacent to the structure.

The various features and advantages of the systems, devices, and methods of the technology described herein will become more fully apparent from the following description of the embodiments illustrated in the figures. These embodiments are intended to illustrate the principles of this disclosure, and this disclosure should not be limited to merely the illustrated examples. The features of the illustrated embodiments can be modified, combined, removed, and/or substituted as will be apparent to those of ordinary skill in the art upon consideration of the principles disclosed herein.

The description of the disclosed implementations is provided to enable any person skilled in the art to make or use the present disclosure. Various modifications to these implementations will be readily apparent to those skilled in the art, and the generic principles defined herein may be applied to other implementations without departing from the spirit or scope of the disclosure. Thus, the present disclosure is not intended to be limited to the implementations shown herein but is to be accorded the widest scope consistent with the principles and novel features disclosed herein.

The foregoing description details certain embodiments of the devices and methods disclosed herein. It will be appreciated, however, that no matter how detailed the foregoing appears in text, the devices and methods can be practiced in many ways. It should be noted that the use of particular terminology when describing certain features or aspects of the invention should not be taken to imply that the terminology is being re-defined herein to be restricted to including any specific characteristics of the features or aspects of the technology with which that terminology is associated.

The innovative systems and methods described herein can be used to stabilize soil areas subject to liquefaction. FIGS. 1 and 2 show an structure 11. The structure 11 can be a building, roadway, dam or other structure. The structure 11 can include a foundation supported on a soil system 10, although no foundation is required for any given structure 11. Such foundation can include footings, pylons, caissons, and the like. The structure 11 can also include a slab (such as a post-tension slab) or raised foundation supporting an elevated floor.

The subject soil system 10 includes a ground surface 12. The ground surface 12 typically is the uppermost surface of one or more underlying soil strata. The soil system 10 can include the compact stratum 14. The compact stratum 14 can be formed of a compact soil material. Compact soil material can include clay, silt and/or any combination thereof. Other materials can also include rock and gravel and other geological materials. The compact stratum 14 can also include loose or sandy soil type material provided that it is in small amounts and/or is not saturated with water. Clay, silt, and loose or sandy soil that is not saturated and/or adequately compacted have a generally low susceptibility to liquefaction. Accordingly, the compact stratum 14 is not considered a risk for liquefaction.

The compact stratum 14 can be located above a loose stratum 16. The compact stratum 14 can have thickness 14*a* between the ground surface 12 and the loose stratum 16. Not all soil systems 10 include a compact stratum 14 above the loose stratum 16. In some installation locations for the structure 11, all of the soil underneath the foundation of the building structure 11 can be loose soil that is subject to liquefaction.

In certain embodiments, the loose stratum 16 can be formed of loose or sandy soil material. In some implementations, a water table 15 can be within or above the loose stratum 16. The water contained in the water table 15 can be located within voids between the grains of the loose soil material 16. The water can saturate the loose soil material 16. Accordingly, the saturated loose soil material 16 is at risk for liquefaction during a seismic event.

In certain embodiments, a third stratum 18 can be located below the loose stratum 16. In certain embodiments, the third stratum 18 can be formed of compact soil, like the compact stratum 14 and/or other geological rock formations, including as bedrock. In certain embodiments, the loose stratum 16 can have a thickness 16*a* from the compact stratum 14 (if any) to the third stratum 18 (if any). In certain embodiments, the thickness 16*a* can vary depending on the location of the soil system 10. In some locations, the thickness 16*a* can be dozens to hundreds of feet thick. Loose soil located at a sufficient depth (e.g., more than approximately 26 feet (8 meters)) is generally not prone to liquefaction because of the stabilizing effect of the weight of higher soil strata on the loose soil. Accordingly, the systems and techniques are generally used to stabilize loose soil at depths less than approximately 26 feet. Accordingly, in certain embodiments, the thickness 14*a* of the compact stratum 14 is typically less than approximately 26 feet.

Injection System

An injection system 20 is used to remediate the loose stratum 16 to inhibit or minimize liquefaction of the loose soil material thereof. In certain embodiments, the injection system 20 can include an injection control system 30 and an injector 40. In certain embodiments, the injector 40 can be representative of a plurality of injectors installed within the soil system 10. In certain embodiments, the injectors 40 can be installed using a pile hammer 31. In certain embodiments, the pile hammer 31 can be a handheld, vibratory pile hammer. In certain embodiments, the pile hammer 31 can be coupled with an upper end 41 of each of the injectors 40 and operated to drive a lower end 42 to an appropriate depth.

In certain embodiments, the injection control system 30 can include an injection nozzle 38 and a pump (or source of pressure 36). In certain embodiments after the injector 40 is installed within the soil system 10, the injection nozzle 38 can be coupled with the upper end 41 (e.g., via a hose or conduit). In certain embodiments, the injection nozzle 38 can be a handheld gun including a trigger for injecting an injection fluid. In some implementations, the injection control system 30 can be located on the ground surface 12.

In certain embodiments, the injection control system 30 can include one or more reservoirs for storing an injection fluid. The injection fluid can expand as it cures. The injection fluid can include polyurethane (PU) or silicate resins, acrylate gels, mineral filling materials, injection mortar, cement paste, cement suspension, aqueous solutions, sealing slurries, fine filler, lime cement plaster, and/or polymer foam expanding materials.

In certain embodiments, the injection fluid can include a two-part polymer foam. Polymer foams including additional components and additives are contemplated herein. In some embodiments, the pump 36 can include or be coupled with a first reservoir 32 and a second reservoir 34 for storing the unmixed components of the two-part polymer. The unmixed components can be liquid components. In certain embodiments, the injection control system 30 can include hoses that connect the first and second reservoirs 32, 34 with the pump 36. In certain embodiments, the pump 36 can include one or more hoses coupled with the injection nozzle 38. In certain embodiments, the first and second liquid components of the two-part polymer foam are stored in the first and second reservoirs 32, 34, respectively. In certain embodiments, the first and second liquid components can be mixed together and form a foam after a sufficient curing time. In certain embodiments, the first and second components of the two-part polymer foam can be mixed together within a chamber of the pump 36, the injection nozzle 38, within the injector 40, and/or when discharged from the injector 40.

The pump 36 can provide sufficient pressure to deliver the two-part polymer foam liquid into the injection nozzle 38. In certain embodiments, the operating pressure range can be from approximately 700 psi to 1,000 psi. In certain embodiments, the injection nozzle 38 can include a pressure regulating device and/or electronic control system for delivering the two-part polymer foam liquid at a designated range of pressures into the injector 40. In certain embodiments, the injection nozzle 38 can include a pressure sensor and feedback loop with the pump 36 to maintain a target pressure of the pressure range. In certain embodiments, the first and second components react to form a polyurethane foam.

In certain embodiments, the pump 36 can be mounted on a truck or other movable piece of equipment. In certain embodiments, the injection control system 30 can be used to service all of the plurality of injectors 40. Alternatively, multiple injection control systems 30 can be utilized for one or more of the plurality of injectors 40.

The injector 40 can include the upper end 41. The upper end 41 can be connected with the injection control system 30. For example, in certain embodiments, the a hose can connect between the upper end 41 and the injection nozzle 38. The injector 40 can include a second end 42. The second end 42 can be a lower end. The second end 42 can be inserted (e.g., drilled) into the soil system 10. In certain embodiments, the injector 40 can extend through the thickness 14*a* of the compact stratum 14 (if any) and into the loose stratum 16 (e.g., using the pile hammer 31). In certain embodiments, the second end 42 can include a drill cap 57.

In certain embodiments, the injector 40 can be generally formed as a pipe. In certain embodiments, the injector 40 can have an outer wall 43 and an inner space. The inner space can transport the two-part polymer foam liquid therethrough. In certain embodiments, the injector 40 can have an outer circular cross-sectional shape, although other cross-sectional shapes can also be suitable. In certain embodiments, the injector 40 can be formed of a metal, such as steel or aluminum, or of a polymer materials.

Figure 2:
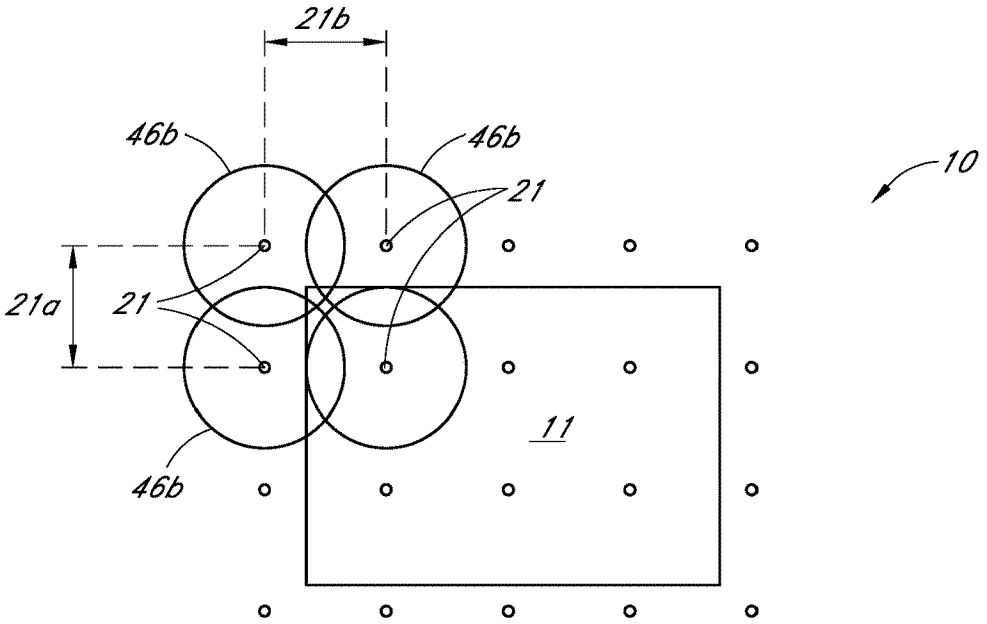
FIG. 2 is a plan view showing a pattern of injection locations around the structure and their associated zones of influence.

FIG. 1A shows an embodiment where the injector 40 goes straight down or perpendicular to the ground surface 12. Alternatively, the injector 40 can be angled with respect to the ground surface 12. An angled injector 40 can be useful for accessing areas prone to liquefaction that are not accessible from directly above due to obstructions on the ground surface 12 (such as the structure 11 or other obstructions within the compact stratum 14).

In certain embodiments, the injector 40 can be comprised of a single length of pipe or multiple lengths of pipe coupled together, as discussed further below. In certain embodiments, the injector 40 can have a uniform shape or diameter between the first and second ends 41, 42. Alternatively, the injector 40 can have a tapered or reversed tapered shape between the first and second ends 41, 42. In certain embodiments, the tapering can promote mixing of the two-part polymer foam components and/or encourage or inhibit flow of the two-part polymer foam liquid through the injector 40. The tapering can also facilitate insertion of the injector 40 within the soil system 10.

The injector 40 can include a proximal portion 44 and a distal portion 46. In certain embodiments, the proximal and distal portions 44, 46 can have the same or different dimensions, e.g., diameters. The proximal portion 44 can include a length 44*a*. In certain embodiments, the length 44*a* of the proximal portion 44 can be selected to span the compact stratum 14. Because the compact stratum 14 is less susceptible to liquefaction it may not necessary to use the two-part polymer foam within the compact soil material thereof. Accordingly, in certain embodiments, the proximal portion 44 is designed to convey the two-part polymer foam liquid through the compact stratum 14. In certain embodiments, the proximal portion 44 is designed to convey the foam liquid as quickly as possible because of the limited cure-time of the mixed two-part polymer foam liquid. In certain embodiments, the proximal portion 44 can be formed of multiple pipe segments 51.

In certain embodiments, the distal portion 46 can extend into the loose stratum 16. In certain embodiments, the distal portion 46 can include a plurality of perforations or lateral openings 48. In certain embodiments, the openings 48 can be through the outer wall 43. In certain embodiments, the distal portion 46 can be formed from multiple pipe segments 53.

In certain embodiments, the lateral openings 48 can extend through the outer wall 43 of the injector 40 and provide a pathway for the two-part polymer foam liquid to escape from the inner space of the injector 40 and into the loose soil material of the loose stratum 16. In certain embodiments, the proximal portion 44 can extend from the surface 12 to the uppermost openings 48 of the distal portion 46. In use in certain embodiments, the drill cap 57 can be forced off of the injector 40 to provide another opening for injection of the foam liquid.

In certain embodiments, the openings 48 can be distributed along a longitudinal length 46*a* of the distal portion 46. In certain embodiments, the length 46*a* can extend through that portion of the loose stratum 16 that is indicated to require remediation due to liquefaction susceptibility. In certain embodiments, the length 46*a* can extend for substantially the thickness 16*a* of the loose stratum 16. In certain embodiments, the openings 48 can be covered by flaps 60 (see FIG. 3B) to inhibit impaction of soil material therein during insertion of the injector 40.

In certain embodiments, a zone of influence 46*b* can define the portion of the loose material of the loose stratum 16 affected by the two-part polymer foam liquid. In certain embodiments, the zone of influence 46*b* can have a diameter that depends on various factors. In certain embodiments, the diameter of the zone of influence 46*b* can depend on the properties of the loose soil material, the pressure applied by the pump 36, the depth of the distal portion 46 from the surface 12 and/or the geometry of the openings 48 or other factors.

Figure 1B:
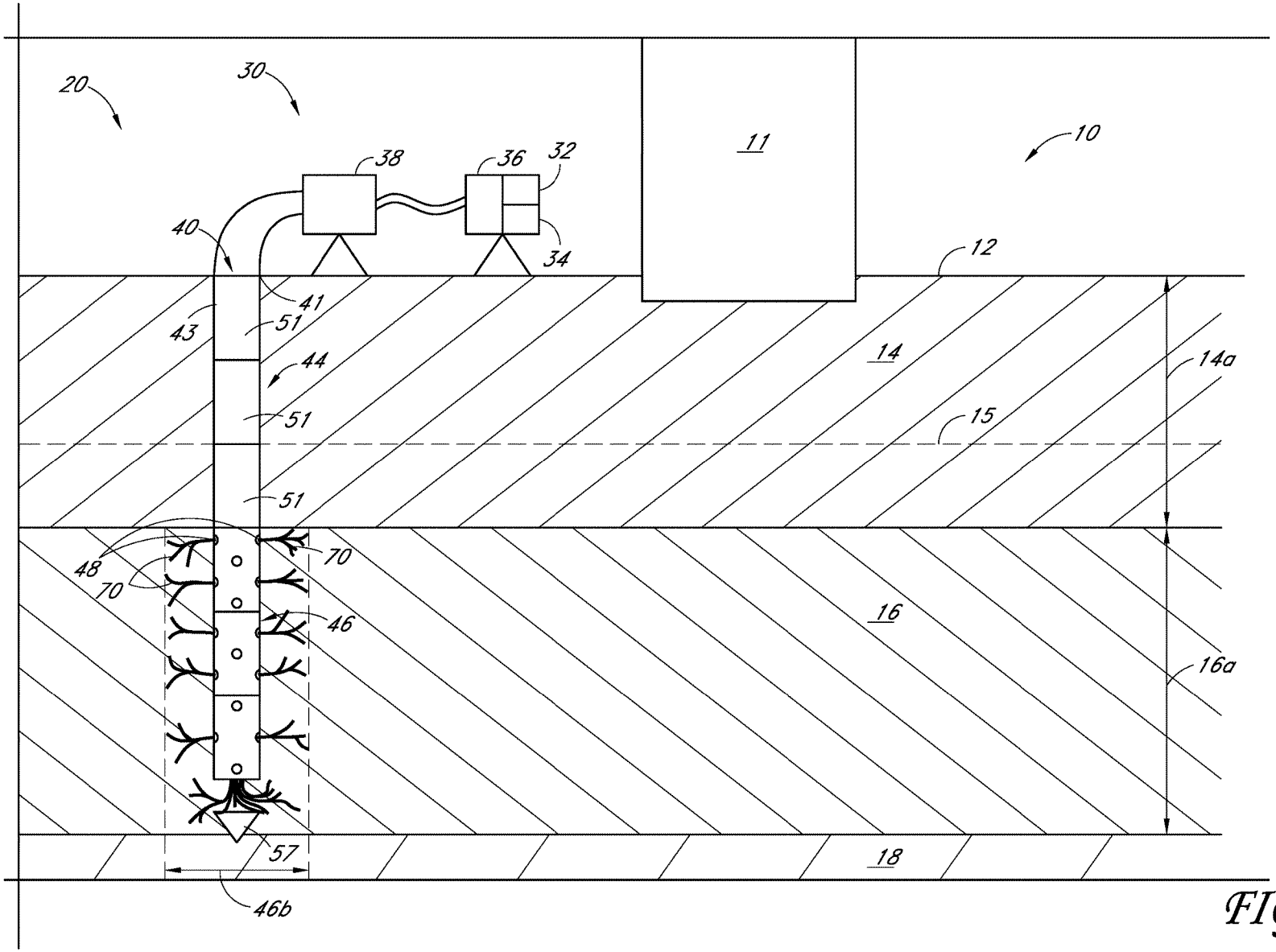
FIG. 1B shows the injection system injecting a stabilizing fluid down through the injector and into the loose stratum below the structure.
Figure 5A:
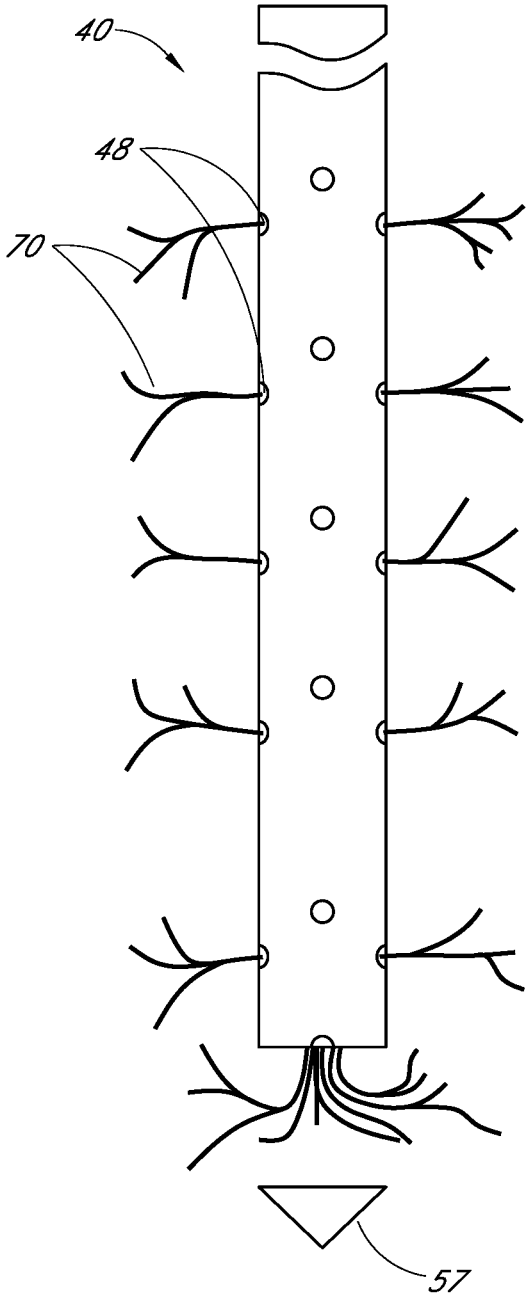
FIG. 5A is a side view of the injection system showing veins of injected material emanating from openings in the injector.
Figure 5B:
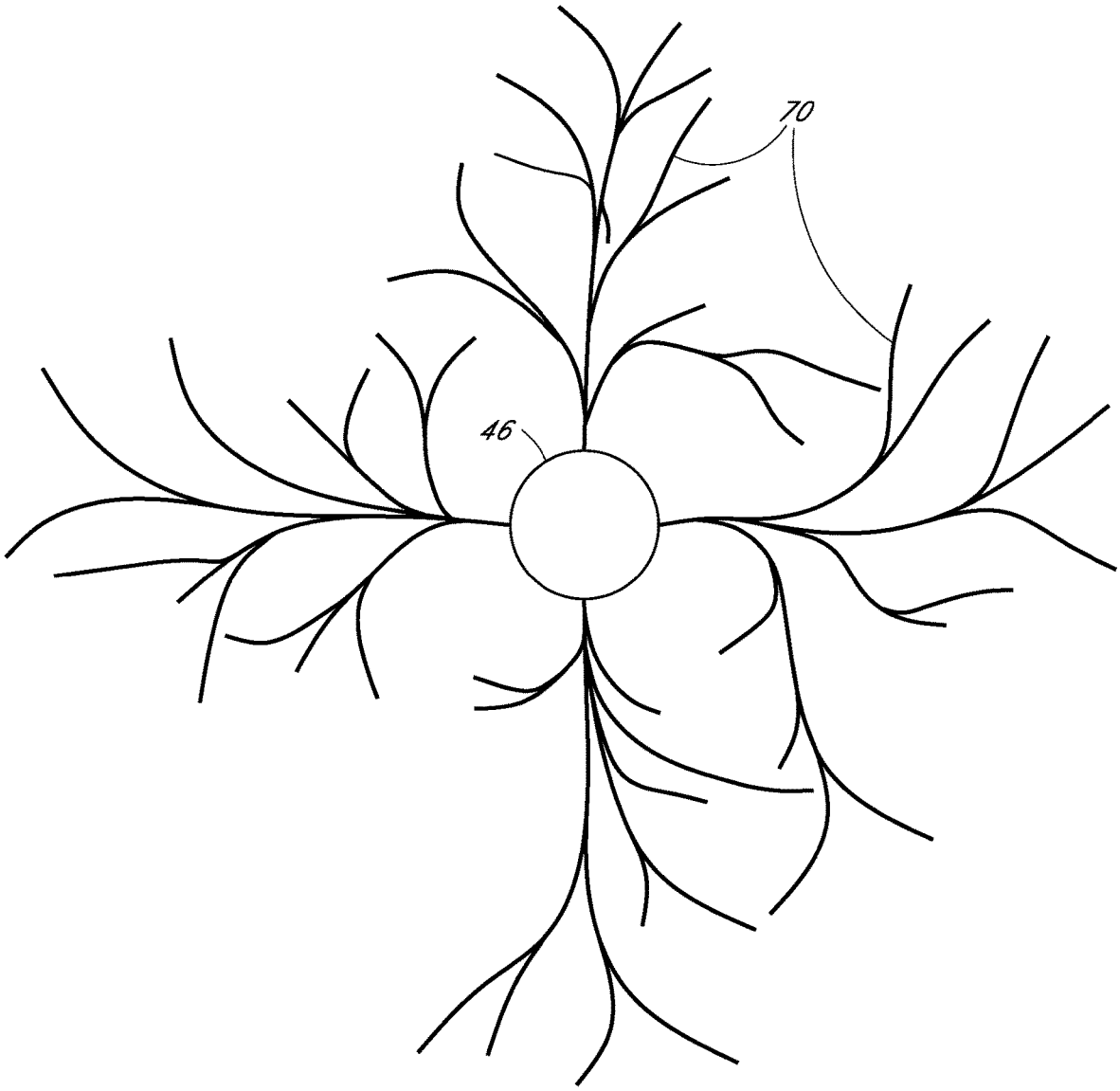
FIG. 5B is a top view of the injection system showing veins of injected material emanating from openings in the injector.

FIG. 1B shows a matrix 70 of the polymer foam injected by the injector 40 and permeated within the loose stratum 16. In certain embodiments, the matrix 70 can substantially fill the loose soil material within the zone of influence 46*b*. As described further below, in certain embodiments, the matrix 70 can assume various shapes and form-factors. In certain embodiments, the matrix 70 can take the form of veins emanating from the openings 48, as shown in FIGS. 5A-B.

In some implementations, components of the injection system 20 can be left within the soil system 10 on a permanent basis. In certain embodiments, these components can include the matrix 70, drill cap 57, proximal portion 44 and/or distal portion 46. Alternatively, all or portions of the injector 40 can be retracted from the soil system 10. For example, a pneumatic lift can be coupled with the injector 40 to retrieve the injector 40.

FIG. 2 shows a plan view of a pattern of injection locations 21 around the structure 11. The injection locations 21 are locations where one of the plurality of injectors 40 is inserted into the soil system 10. The injection pattern can be designed to safely and effectively support the structure 11 (if any structure) and/or to reinforce the soil system 10 (e.g., on a slope). The soil system 10 can be remediated either before or after installation of the structure 11 (if any). If after installation, the foundation of the structure 11 can be drilled through to provide holes to insert the injectors 40 at each of the injection locations 21. Otherwise, the holes can be angled around the foundation in certain embodiments.

In certain embodiments, the injection location pattern can include rows and columns of injection locations 21. In certain embodiments, the injection location pattern can extend within a predetermined proximity to the structure 11. In certain embodiments, the predetermined proximity can be based on the liquefaction risk of the loose stratum 16. In certain embodiments, the injection locations 21 can be spaced apart in orthogonal directions at spacings 21*a*, 21*b*. As shown, the injection locations 21 are laid out in a grid. Adjacent rows or columns can be offset from each other in the grid. Other injection location patterns are also acceptable such as, but not limited to hexagonal or triangular. A random pattern can also be acceptable depending on the soil system 10.

In certain embodiments, the zone of influence 46*b* for each of the injectors 40 can overlap with adjacent zones of influence, depending on the spacings 21*a*, 21*b* and the diameters of the zones of influence. In certain injection location pattern embodiments, all areas of the loose stratum 16 within the injection location pattern are remediated by at least one of the injectors 40. The spacings 21*a*, 21*b* can be 3.0 feet on center. In certain embodiments, a range for the spacings 21*a*, 21*b* can be approximately from 2.0 to 4.0 feet. In certain embodiments, the zone of influence 46*b*, depending on soil conditions and injection methodology can be approximately 4.0 feet in radius. In certain embodiments, a range of values for the zone of influence can be approximately from 2.0 to 6.0 feet in radius. The relationship of the zones of influence 46*b* and the spacings 21*a*, 21*b* are discussed further below.

Figure 3A:
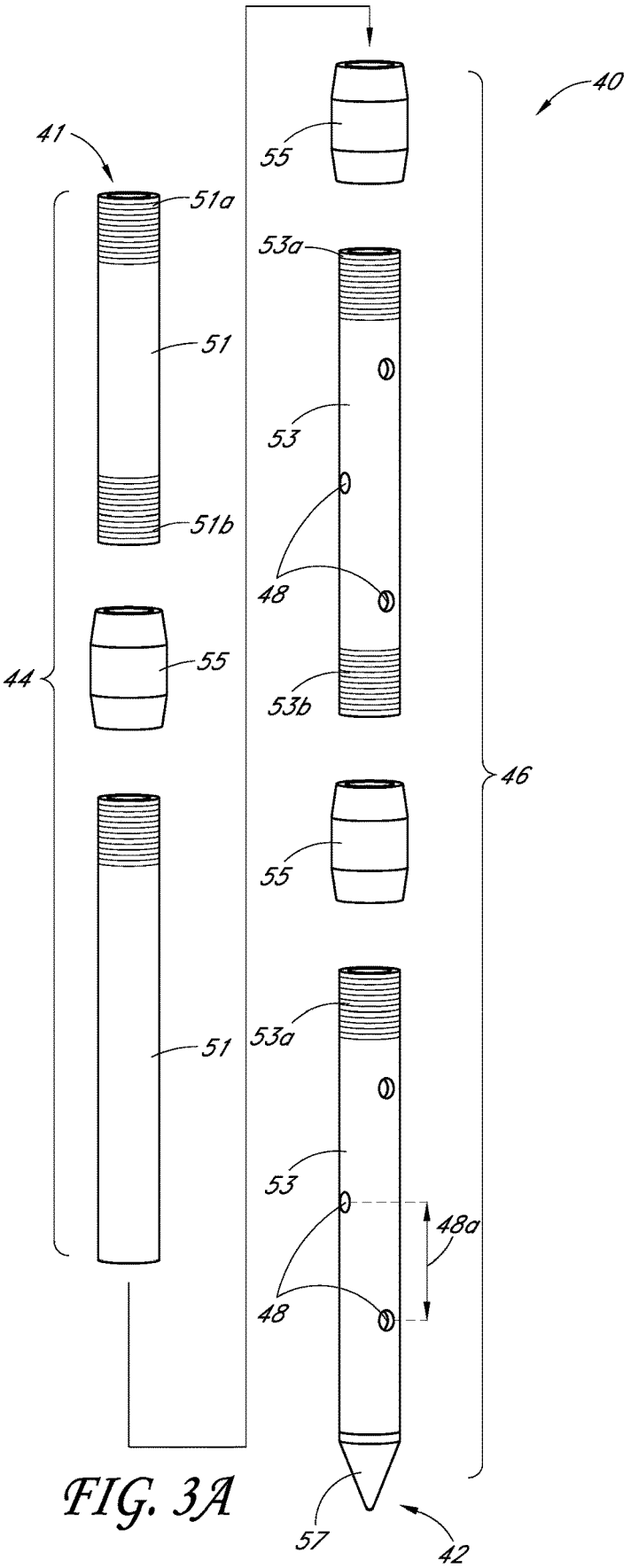
FIG. 3A shows a first exploded embodiment of an injector for use with the methods and systems disclosed herein.
Figure 3B:
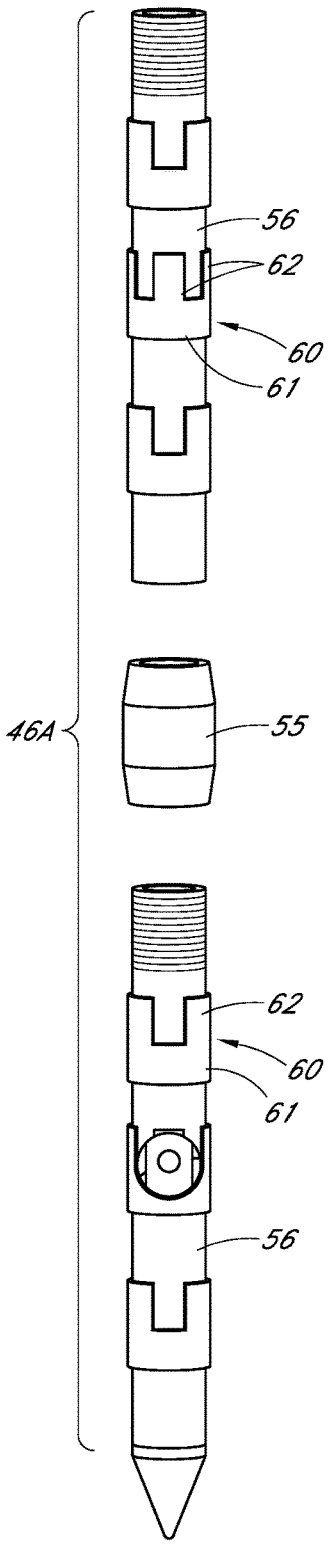
FIG. 3B shows a second exploded embodiment of an injector for use with the methods and systems disclosed herein.

FIG. 3A shows a first exploded embodiment of the injector 40 from FIG. 1A. FIG. 3B shows a second exploded embodiment of an injector 40. The proximal portion 44 can be comprised of one or more pipe segments 51. In certain embodiments, each of the pipe segments 51 can include ends 51*a*, 51*b* having threads. In certain embodiments, the ends 51*a*, 51*b* can be connected together between adjacent pipe segments 51 by one or more connectors 55. In certain embodiments, the connectors 55 can include corresponding (e.g. female) threaded receptacles. Other connection mechanisms between the pipe segments 51 are also contemplated herein. In certain embodiments, the ends 51*a*, 51*b* can include alternating male and female threads so that pipe segments 51 can be connected together in series without connectors 55. In certain embodiments, the ends 51*a*, 51*b* can include flanges and the connectors 55 can be collars for coupling together the flanges. In certain embodiments, the pipe segments 51 can be 3.0 feet in length or range in length from approximately 2.0 feet (or less) to 6.0 feet (or more). In certain embodiments, a range of the diameter of the pipe segments 51 can be from 0.5 inch to 1 inch (or more) (e.g., 16 mm). In certain embodiments, the pipe segments 51 can have circular, oval, rectangular, or any other shaped cross-sectional profile.

In certain embodiments, the distal portion 46 can be composed of one or more pipe segments 53. In certain embodiments, the pipe segments 53 can be coupled together like the pipe segments 51 (e.g., threaded ends 53*a*, 53*b* coupled by connectors 55 or alternatives). In certain embodiments, the pipe segments 53 can have the same overall dimensions as the pipe segments 51.

In certain embodiments, one or more of the pipe segments 53 can include one or more openings 48. The openings 48 can have various shapes or profiles. The openings 48 can be round, although square, rectangular, star or other opening shapes are also contemplated herein. In certain embodiments, the shape of the opening can be selected to improve the injection performance. In certain embodiments (e.g., round), the openings 48 can include a diameter. In certain embodiments, a range of the diameter can be approximately from 0.0625 in. (or smaller) to 1.0 in. (or larger). The diameter can be selected based on the desired properties of the stream of two-part polymer foam liquid that is released through the openings 48. In certain embodiments, the openings 48 can be angled radially outwardly or angled outwardly with respect to the pipe wall. In certain embodiments, the openings 48 can include nozzles extending from the wall of the pipe segments for directing the foam liquid into the loose stratum 16.

In certain embodiments, the openings 48 can be organized in successive circumferential rows that are spaced apart along a longitudinal axis of the distal portion 46. As shown in FIG. 3A, a spacing distance 48*a* can define the distance between successive rows of openings 48. In certain embodiments, a range of the spacing distance 48*a* can be from 1.0 in. (or less) up to the length of the pipe segment 53. In certain embodiments, the pipe segment 53 can include multiple rows of openings 48. In certain embodiments, the openings 48 can extend around an outer circumference of the pipe segments 53. In certain embodiments, the clocking or spacing of the openings 48 in a single row can be uniform or varied over the length of each of the pipe segments 53. In certain embodiments, the openings 48 of each row are clocked from 5° to 120° around the circumference. In certain embodiments, the clocking is 90 degrees and each row includes four openings 48. In certain embodiments, successive rows of openings 48 can be clocked the same or can be offset from each other. In certain embodiments, each row can include from 1 to 10 (or more) openings 48. In certain embodiments, each pipe segment 53 can include from 1 to 100 (or more) openings 48.

FIG. 3B illustrates another embodiment of a segment 46A for the distal portion 46. The segment 46A can include pipe segments 56. The pipe segments 56 can be similar in makeup to the pipe segments 51 and/or 55. In certain embodiments, each of the pipe segments 56 further includes one or more outlet opening covers 60. In certain embodiments, the outlet opening covers 60 can inhibit impaction of soil material within the injector 40 when drilled into the soil system 10. In certain embodiments, each of the outlet opening covers 60 includes a collar 61 affixed to an outer circumference of the pipe segment 56. In certain embodiments, each of the outlet opening covers 60 further includes one or more flaps 62. In certain embodiments, each flap 62 extends from the collar 61 to cover one of the openings 48. In certain embodiments, the outlet opening covers 60 can prevent the intrusion of impurities within the injector 40 (through the openings 48). This feature can be particularly suitable for sandy or water-bearing soil layers.

In certain embodiments, all of the openings 48 of the distal portion 46 are covered by the corresponding one or more flaps 62 of each of the one or more outlet opening covers 60. In certain embodiments, each of the one or more flaps 62 moves from a closed position to an open position. For example, the one or more flaps 62 can open when pressure is applied by the two-part polymer foam liquid against an inner surface of the one or more flaps 62. The flap 62 can have a flexing resistance. The flexing resistance of the flap 62 can be selected and configured to provide desirable injection properties for the two-part polymer foam liquid into the loose stratum 16 through the openings 48. In certain embodiments, when the two-part polymer foam is discharged into the loose stratum 16, the flaps 62 deflect away from the pipe segments 56 to open the openings 48.

In certain embodiments, the pipe segments 56 can include one or more mechanical valves. The mechanical valves can be disposed at the one or more openings 48 and/or within the pipe segments 56. In certain embodiments, the valves can include an open/close mechanism. The open/close mechanism can be actuated remotely from the surface 12. The open/close mechanism can be a sliding valve cover or a coaxial sliding sleeve over the pipe segment 56. In certain embodiments, the valves could also have pressure regulating mechanisms that allow release of the two-part polymer foam liquid above a certain predetermined threshold pressure. In certain embodiments, the predetermined threshold pressure can be selected to enhance the penetration of the two-part polymer foam liquid into the loose stratum 16.

In certain embodiments, the second end 42 of the injector 40 can include an end cap 57. The end cap 57 can be coupled with a distal most portion of the injector 40 (e.g., at one of the pipe segments 53 or 56). In certain embodiments, the end cap 57 can be threaded onto the pipe segment 53. In certain embodiments, the end cap 57 can be pointed, rounded or blunt. Alternatively, no end cap 57 is included. In certain embodiments, the end cap 57 can be attached by an O-ring within the injector 40. In certain embodiments, the end cap 57 can be ejected during the injection process. In certain embodiments, the final pipe segment 53 can include an opening under the end cap 57 for release of the two-part polymer foam liquid.

Injection

In certain embodiments, the two-part polymer foam can comprise two (or more) liquid components. When mixed, the resulting liquid can have the specifications as set forth below under EL003 Geotechnical Foam System in certain embodiments. For example, certain specifications include cream time, tack free time, and rise time. In certain embodiments, the two-part polymer foam can expand to occupy up to 10 cubic feet or 10 times its liquid volume.

In certain embodiments, the two-part polymer foam can be a hydrophobic/hydro-insensitive, plural component, polymeric MDI-based polymer system for void filling in wet environments. The two-part polymer foam can be formulated for exceptional flow or spread under structures 11 when water is present. In certain embodiments, the two-part polymer foam is a thermoset.

One example of a two-part polymer foam is the EL003 Geotechnical Foam System from EAGLELIFT, INC, for which a technical data sheet is provided in Table 1 below.

TABLE 1

EL003 Geotechnical Foam System
Eagle Lift EL003 is a hydrophobic/hydro-insensitive, plural component, polymeric MDI-based polymer system designed for concrete lifting/leveling, joint matching, void filling and concrete under-sealing in wet environments. This system has been specially formulated for exceptional flow or spread under concrete road or slab section(s) when water is present. In certain applications this system can be used for deep soil injection applications when soil conditions dictate.

Typical Properties of Components

| Component | B-EL003 | A-EL003 |
|---|---|---|
| Appearance | Transparent black liquid | Transparent brown liquid |
| Brookfield Viscosity @ 30 rpm | 500 cps at 72° F. | 200 cps at 72° F. |
| Specific Gravity | 1.07 | 1.24 |
| Storage Temperature | 50° F.-100° F. | 50° F.-110° F. |

Mix Ratio

| | |
|---|---|
| By weight | 100 parts poly:116 parts iso |
| By volume | 100 parts poly:100 parts iso |

Typical Properties of Hand-Mixed System at 72° F. and thru HPIM equipment

| | at 72° F. | at 120° F. thru equipment |
|---|---|---|
| Cream Time | 22 seconds | 7 seconds |
| Tack Free Time | 60 seconds | 14 seconds |
| Rise Time | 90 seconds | 15 seconds |
| Free Rise Core Density | 4 pcf | 3 pcf |

Process Parameters

| | |
|---|---|
| Iso Temperature | 100° F. to 130° F. |
| Poly Temperature | 100° F. to 130° F. |
| Mixing Pressure | Minimum 800 static, 600 dynamic psi, 1000/800 preferred |

Typical Foam Physical Properties

| | |
|---|---|
| In-Place Density (ASTM D-1622) | 3-6 pcf |
| Compressive Strength (ASTM D-1621), parallel to rise | 80-100 psi |
| Compressive Modulus (ASTM D-1621), parallel to rise | 2400-3200 psi |
| Tensile Strength (ASTM D-1623), parallel to rise | 100-120 psi |
| Flexural Strength (ASTM D790) | 387 psi |
| Flexural Modulus (ASTM D790) | 13502 psi |
| Shear Strength (ASTM C273) | 90 psi |
| Shear Modulus (ASTM C273) | 677 psi |
| Closed cell content | >92% |
| Water Absorption (ASTM D-2842) | ≤0.04 lbs/ft$^2$ |
| NYDOT Hydro-Insensitivity test, GTP-9 | >96% density retention<br>>93% comp str retention |

Dimensional stability, % volume change (ASTM D-2126)

| | Heat age at 158° F. | Freezer at −20° F. | Humid age at 100% RH & 120° F. |
|---|---|---|---|
| 28 day aging | −1.5% | −0.1% | −1.0% |
| Resistance to Solvents | | | Excellent |
| Resistance to Mold and Mildew | | | Excellent |
| Maximum service temperature | | | 200° F. |

Storage and Handling

Store the poly from 50° F. to 100° F. Avoid moisture contamination during storage, handling, and processing. For both components, pad containers and day tanks with either nitrogen or dry air (desiccant cartridge or air dryer @ −40° F. dew point). For optimum shelf life, the recommended storage temperature for iso is 50° F. to 110° F. Do not expose iso to lower temperatures - freezing may occur. Shelf life is 6 months for factory sealed containers. To insure handling safety, consult the Safety Data Sheets associated with this product.

Injection Methodology

Figure 4:
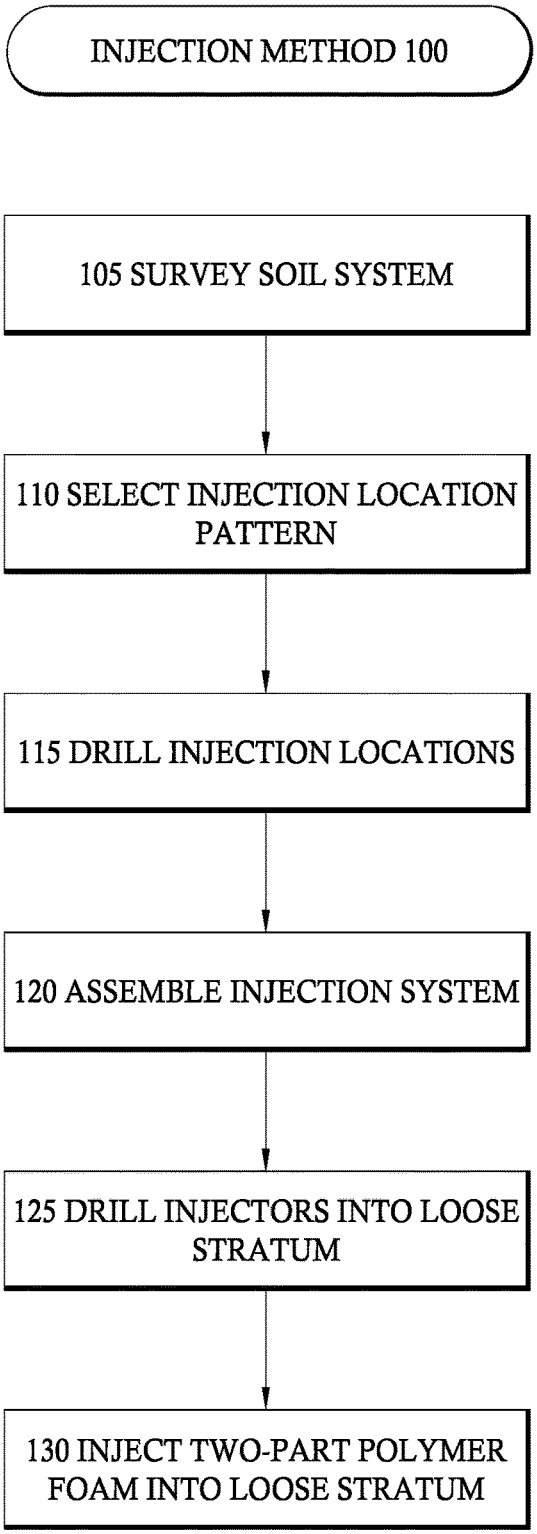
FIG. 4 is a flow chart for a method of stabilizing the loose stratum with the injection system.

FIG. 4 is a flowchart of an exemplary injection method 100. The injection system 20 can be used in the injection method 100 to inject a two-part polymer foam liquid into the loose stratum 16 to mitigate liquefaction potential within the loose soil thereof.

At step 105 in certain embodiments, a survey of the location and thicknesses of the soil system 10 can be conducted. The survey can identify areas of potential liquefaction and/or other properties of the soil system 10. One or more core samples can identify the thicknesses and contents of the compact stratum 14 and the loose stratum 16. In certain embodiments, the location of the water table 15 (see FIG. 1A) can be determined by drilling a hole and measuring the depth of water that fills in the hole. The liquefaction potential of the soil can be determined using the Standard Penetration Test. Soil that has a high Standard Penetration Test resistance will have a lower liquefaction potential (e.g., more compact). In certain embodiments, a cone penetration testing (CPT) is employed. Certain soil properties can be determined by performing a soil sieve analysis. Atterberg limits testing can be used to measure the critical water content of soils. These tests include shrinkage limit, plastic limit, and liquid limit. Depending on the water content of a soil, it may appear in four states: solid, semi-solid, plastic, and liquid.

At step 110 in certain embodiments, the injection location pattern can be determined. The injection location pattern can be based on several inter-related variables. These variables can include the desired spacings 21*a*, 21*b* of the injection location pattern, the zone of influence 46*b* for each of the injectors 40, and/or the amount of the two-part polymer foam that can be injected into a single injection location. One or more of the variables can be selected and/or determined based on the soil properties. Other variables can be determined based on the selected or determined variables.

The spacings 21*a*, 21*b* and/or layout of the injection location pattern can be determined based on the determined zone of influence 46*b* for each of the injection locations 21. The spacings 21*a*, 21*b* can be selected to optimize the coverage of the loose stratum 16. Alternatively, the spacings 21*a*, 21*b* can be selected and the amount of two-part polymer foam that can be injected and/or the zone of influence 46*b* diameters can be determined based on the selected spacing distances 21*a*, 21*b*.

The zone of influence 46*b* of the two-part polymer foam can be determined based on the soil properties of the loose stratum 16, the thickness of the loose stratum 16, the curing properties of the two-part polymer foam liquid, the pressure applied by the injection system 20 and/or other properties of the soil system 10 or injection system 20.

The amount of the two-part polymer foam liquid that can be injected into a single injection location can be determined based on the properties of the loose stratum 16 (e.g., maximum permeation). The amount of two-part polymer foam injected can at least partially determine the zone of influence 46*b*.

Other variables for selecting the injection location pattern can include the depth of the loose stratum 16, the footprint and weight of the structure 11 (if any), the size of the grain of the loose soil material, the compaction of the loose soil material 16, the height of the water table 15 within the loose soil material, the area of the loose stratum 16 that will be impacted and remediated through the injection process and/or other variables.

At step 115 in certain embodiments, the foundation of the structure 11 (if any) can be drilled through for any injection locations 21 located on the foundation. Alternatively, this step may be skipped. The foundation of the structure 11 can be drilled out by a drill head, if necessary.

At step 120 in certain embodiments, the injectors 40 can be assembled. Assembly can include assembling of the distal portion 46 and the proximal portion 44 with appropriate numbers and lengths of the pipe segments 51, 53, or 56. The length of the proximal portion 44 can be selected to extend through the compact stratum 14 and access the loose stratum 16. The length of the distal portion 46 can be selected to extend through at least a portion of the loose stratum 16 designated for liquefaction remediation.

At step 125 in certain embodiments, the injector 40 is drilled into the soil system 10 for each of the injection locations 21. The injector 40 can be inserted using Kelly drilling, continuous flight auger drilling, full displacement drilling, double rotary drilling, drilling with hammer grab, reverse circulation air injection drilling and/or down-the-hole drilling. As noted above, the injectors 40 can be angled beneath the structure 11 or to avoid other obstructions within the soil system 10. The distal portions 46 can be located within the loose stratum 16 by the drilling. The injection control system 30 can be coupled, successively, with each of the injectors 40 to complete the injection process for the two-part polymer foam.

At step 130 in certain embodiments, the injection system 20 can mix the two components of the two-part polymer foam from the first and second reservoirs 32, 34. The two components can react to form a tacky foam liquid. The pump 36 can pump the foam liquid into the injector 40. In some implementations, the injection system 20 can inject a predetermined amount of the two-part polymer liquid down the injector 40. Alternatively, the injection system 20 can inject the two-part polymer liquid in the soil system 10 until a visible heave at the surface 12 is detected (e.g., by an operator). The visible heave can indicate permeation (fully or partial) of the loose soil stratum 16 by the two-part polymer liquid. Due to the high diffusion rate of the polymer in its liquid form and low confinement, permeation of the polymer into the soil system 10, lower quantities of the polymer are required to cause soil heave at points further from the first injection point. Accordingly, according to one method of application, the polymer can be injected in an innermost injector 40 (e.g., within a system of injectors 40) and proceed to an outermost injector 40. In this manner, an efficient dispensing of the polymer into the loose stratum 16 can be effected.

In certain embodiments, the foam liquid, either mixed or in component parts, can be heated to be within a temperature range of 72° F. to 120° F., depending on injection depth and soil type in certain embodiments.

The foam liquid can proceed through the proximal portion 44 to the distal portion 46. The foam liquid can be injected under pressure into the loose stratum 16 through the one or more openings 48. In certain embodiments, the injection control system 30 can monitor the amount of foam liquid injected and/or the pressure applied by the pump 36. In certain embodiments, the foam liquid can still be in liquid or tacky form when injected into the loose stratum 16. In certain embodiments, the foam liquid can remain as a flowable liquid from 7 to 22 seconds in certain embodiments. In certain embodiments, the foam liquid can permeate into the voids between the grains of the loose soil material and displace the water contained therein. The foam liquid can slowly cure into a solid foam. Cure time can be from 20 to 60 minutes in certain embodiments. In certain embodiments, the solid foam can bind with the grains of the loose soil stratum 16 and inhibits the return of the water. In certain embodiments, the solid foam can also bind or glue together the grains of the loose soil stratum 16.

In certain embodiments, the pressure of the foam liquid can open the outlet opening covers 60 (if any). In certain embodiments, the foam liquid flexes the flaps 62 to open the outlet opening covers 60 to allow the injection of the foam liquid from the one or more openings 48 in the injector 40.

In certain embodiments, the tacky foam/liquid can cure to form the solid foam matrix 70 surrounding each of the injectors 40 as shown in FIGS. 5A and 5B. Each solid foam matrix 70 can have a hub structure parallel to and within the injector 40. The solid foam matrix can be coupled to a plurality of stacked spoke structures via successive circumferential rows of solid foam spokes exiting the one or more openings 48 in each row. The matrix 70 can take the form of veins emanating from the respective openings 48.

In certain embodiments, the injector 40 or portions thereof can be left permanently in the soil system 10. The solid foam matrix formed with the loose soil material can inhibit the re-entry of water into the loose soil, thereby inhibiting liquefaction permanently.

Other solid foam matrix shapes formed by the injected polymer foam can include a single vertical column, one or more radially extending horizontal columns extending from the openings 48, a generally continuously connected array of radially extending horizontal columns, and/or vertical connection portions between the 3D matrixes formed through adjacent openings 48 or successive rows of openings 48.

An alternate methodology can use an injector 40 in the form of a pipe with an opening in the bottom or a limited number of openings (e.g., a single row of openings). The liquid of the two-part polymer foam can be injected out the bottom or openings and the injector can be raised or lowered and/or rotated to inject the liquid polymer into the stratum 16 at various depths. Similar to the above methodology, the liquid polymer can permeate the loose soil material surrounding the injector 40.

Test Data

A shake table testing program was conducted at the University of California, San Diego to assess the potential of the polymer injection technique as a liquefaction countermeasure. Using a polymer liquid injection technique, a 95% reduction in liquefaction was achieved (compared with a control). The testing is overviewed below and in FIGS. 6A-6C. Further detail on the testing can be found in *Polymer Injection and Liquefaction Induced Foundation Settlement: A Shake Table Testing Investigation* by Athul Prabhakaran, Kyungtae Kim, Ph.D., Milad Jahed Orang, Zhijian Qiu, Ahmed Ebeido, Ph.D., Muhammad Zayed, Reza Boushehri, Ramin Motamed, Ph.D., P. E., Ahmed Elgamal, Ph.D., and Cliff Frazao, the entirety of which is hereby incorporated by reference.

The test system 200 included a large laminar soil container 210 (13 ft.×6 ft.×10 ft.) which was placed on a shake table 201. A foundation 211 was placed on a sand layer 214 (0.64 meter thick; e.g., medium dense sand), with a large saturated liquefiable layer 216 (1.25 meter thick; e.g., loose sand). A dense layer 217 of sand including a bottom layer 218 was provided below the liquefiable layer 216. In a series of two shake table tests, the system 200 response was studied first without, and subsequently with polymer injected into the liquefiable layer 216. Strong base excitation was imparted by the shake table 201, resulting in liquefaction and excessive foundation settlement in the original benchmark experiment (e.g., without polymer injection).

In the second test, after application of the polymer injection countermeasure, major reduction was observed in the tendency for liquefaction, and in the resulting foundation settlement. Excavation after the shaking event provided additional insights as to the configuration of the solidified polymer within the sand layer 214. These insights included an increase in the overall soil confinement and solidified load paths for the shallow foundation load towards the bottom layer 218.

Figure 6A:
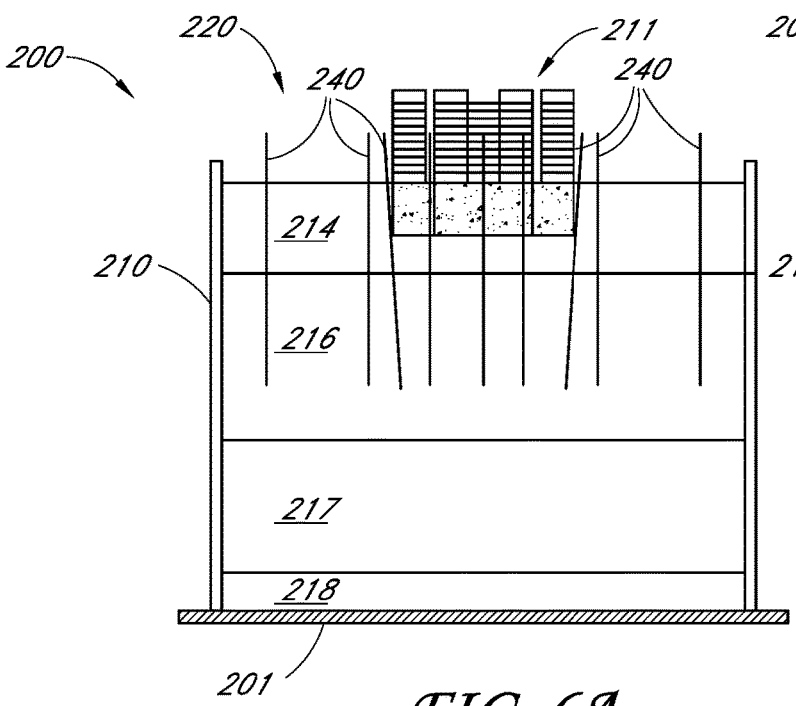
FIGS. 6A-C show views of a soil system and experimental polymer injection system.
Figure 6B:
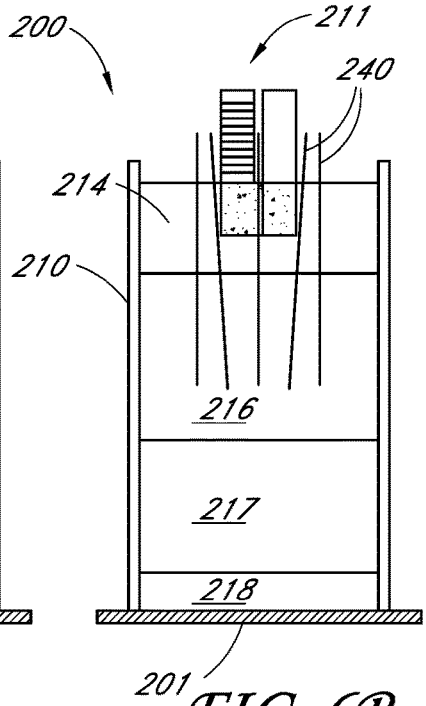
Figure 6C:
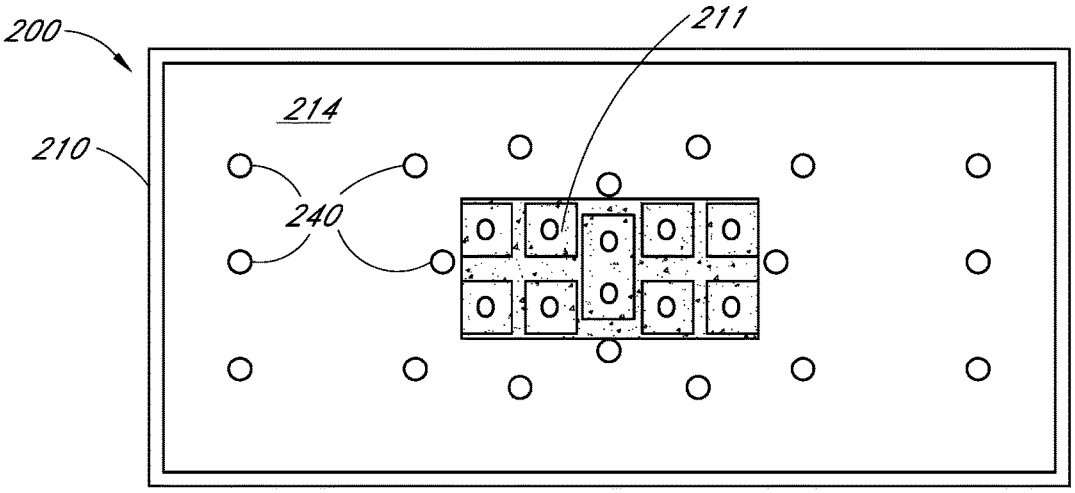

Eighteen injection tubes 240 (16 mm diameter) were inserted into the soil container 210 as shown in FIG. 6A-C. The two-component polymer (polyurethane) was injected through a delivery system, where the two components mix forming the expansive polymer. Mechanical properties of the pure polymer are presented in Table 1 (above). In this experiment, the injection was performed at one specific elevation and all injection tubes are inserted to a depth of 1.5 m into the soil container 210 (0.9 m into the loose liquefiable layer 216). The injection was performed at the base of the liquefiable layer 216 to force the polymer to effectively diffuse to deeper strata and then further expand towards the soil surface. Prior to injection, locations were marked, and the tubes 240 were inserted using an impact driver. Of the eighteen injection tubes 240, four injection tubes 240 were deployed at an angle from each lateral face of the foundation to its center, as seen in FIGS. 6A-B.

Polymer liquid was injected through the injection tubes 240 until visible soil heave was observed at the surface. Injection was performed along each row, as shown in FIG. 6C. Due to the high diffusion rate of the polymer in its liquid form and low confinement, permeation of the polymer into the soil container 210 causing soil heave at points further from the first injection point was achieved with lower quantities of the polymer. In total, 721.5 lbs. of the polymer in its liquid form was injected into the soil model. On average, 46±25 lbs. of the polymer was injected in its liquid form at each injection point.

After curing the injected polymer and performing the shaking simulation, the soil container 210 was excavated. In the hardened polymer composite, two distinct phases were observed. 1) Solidified interface sand: during injection, the polymer fractures through the soil model and permeates into the sand. On curing, cementation occurs, and a percentage of sand is hardened. This region is typically along the surface of the hardened composite. 2) Pure polymer: after mixing, the polymer expands from its initial liquid volume. In addition, this leads to a separation of surfaces where soil cementation occurs.

Several characteristic formations of the composite were observed within both the sand layer 214 and the liquefiable layer 216. Within the liquefiable layer 216, at the depth of injection, a continuous zone of solidified polymer sand composite of thickness 8-13 cm was observed. Specimens of large densities were observed in this region, suggesting extensive permeation of the polymer within the liquefiable layer 216. From this dense mat, veins of the polymer emanate into the sand layer 214, oriented along the compliant direction of the laminar container. The formation was attributed to the quick initial set time of the polymer, as the polymer could not permeate into deeper strata at a rate faster than the rate of curing. Further penetration could be attained, using either higher injection pressure or a polymer with a higher initial set time to attain higher permeation/mixing.

Within the sand layer 214, specimens of lower density were observed with thinner fractions of the polymer sand interface, suggesting a reduced extent of mixing and more expansion. Hence, specimens of much lesser density were observed in the sand layer 214 as compared to the liquefiable layer 216, indicating the lesser extent of soil mixing. During injection, the liquid polymer reaching the sand layer 214 had significantly higher viscosity as compared to its initial liquid form. Thin interface zones with large zones of pure polymer were observed at shallow depths.

As a result of this test, the settling of the foundation 211 was reduced by 95% compared with the benchmark (no polymer injection) for the same soil conditions and shaking on the shake table 201. This improvement is attributed to a marked increase in the soil resistance to liquefaction due to cementation and additional lateral confinement provided by the expansive polymer, after permeation. Moreover, as the injection tubes 240 were deployed around the foundation 211, the excavation showed the presence of clear load paths, capable of transmitting the foundation load downward toward the bottom layer 218 of the dense layer 217. Once the soil beneath the foundation softened during shaking, the channels of the composite polymer sand formations were observed to transmit foundation loads to the deeper layers 271, 218. Such shear reinforcement provides additional stiffness to loose liquefiable sites, reducing the shear transmitted to the in-situ soil in the soil container 210.

It will be appreciated by those skilled in the art that various modifications and changes may be made without departing from the scope of the described technology. Such modifications and changes are intended to fall within the scope of the embodiments. It will also be appreciated by those of skill in the art that parts included in one embodiment are interchangeable with other embodiments; one or more parts from a depicted embodiment can be included with other depicted embodiments in any combination. For example, any of the various components described herein and/or depicted in the Figures may be combined, interchanged or excluded from other embodiments.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

The above description discloses several methods and materials of the present invention. This invention is susceptible to modifications in the methods and materials, as well as alterations in the fabrication methods and equipment and in the installation methods and equipment. Such modifications will become apparent to those skilled in the art from a consideration of this disclosure or practice of the invention disclosed herein. Consequently, it is not intended that this invention be limited to the specific embodiments disclosed herein, but that it cover all modifications and alternatives coming within the true scope and spirit of the invention as embodied in the attached claims.

What is claimed is:

1. A system for reinforcing a soil stratum with increased liquefaction potential, comprising:

a plurality of injectors, each injector including:

a proximal portion having a hollow shape and a solid outer wall, the proximal portion having a sufficient length to span from a ground surface to the soil stratum, and a distal portion having a hollow shape and a perforated outer wall; and an injection nozzle configured to couple with each of the plurality of injectors;

wherein, in use, the plurality of injectors are inserted within the soil stratum and a liquid polymer is pumped from the injection nozzle into the soil stratum through the plurality of injectors, the liquid polymer exits the perforated outer wall of the distal portions of the plurality of injectors, and the liquid polymer hardens to displace water from within the soil stratum;

wherein the perforated outer wall comprises a plurality of openings, the plurality of openings being covered by a plurality of covers corresponding to the plurality of openings when the plurality of injectors are inserted into the soil, and the plurality of covers being configured to open the plurality of openings in the perforated outer wall when sufficient pressure is applied by the liquid polymer when exiting the perforated outer wall through the plurality of openings.

2. The system of claim 1, wherein the distal portion has a length generally corresponding to the thickness of the loose soil stratum.

3. The system of claim 1, wherein each injector of the plurality of injectors includes a zone of influence and foam veins disposed within each respective zone of influence.

4. A method for the reduction of liquefaction potential within soil of a stratum located deep below a foundation of a structure, comprising:

determining a distance from the foundation to the stratum and a thickness of the stratum;

determining one or more soil properties of the stratum;

providing a plurality of injectors, each injector of the plurality of injectors having a hollow shape over a proximal portion and a distal portion, the proximal portion having a solid outer wall and a length generally corresponding to the distance from the foundation, the distal portion having a perforated outer wall and a length generally corresponding to the thickness of the stratum;

selecting a spacing distance for drilling a plurality of holes through the foundation;

determining a zone of influence based on at least the selected spacing distance and the one or more soil properties;

determining a mass of a two-part polyurethane liquid for injecting into the stratum based on at least the zone of influence determined;

drilling the plurality of holes through the foundation at the selected spacing distance;

drilling in the plurality of holes and through the soil with the plurality of injectors;

locating the distal portion of each of the plurality of injectors within the stratum;

injecting the mass determined of the two-part polyurethane liquid down each of the plurality of injectors and into the stratum via the perforated outer wall of the distal portion;

permeating the stratum with the two-part polyurethane liquid injected while the two-part polyurethane liquid reacts forming a tacky foam, the tacky foam displacing water and binding to the soil within the stratum; and curing the tacky foam to form a solid foam matrix comprising particles of the soil within the stratum.

5. The method of claim 4, wherein the one or more soil properties of the stratum include soil compactness, critical water content, shrinkage limit, or plastic limit.

6. The method of claim 4, wherein the stratum comprises loose sand.

7. The method of claim 4, wherein the soil comprises a second stratum disposed above the stratum, the second stratum comprising sand having a higher density than sand in the stratum.

8. The method of claim 4, wherein the perforated outer wall comprises a plurality of openings, the plurality of openings being covered by a plurality of corresponding covers when the plurality of injectors are drilled into the soil.

9. The method of claim 4, wherein the spacing distance is 3 feet on center between the injectors of the plurality of injectors.

10. The method of claim 4, wherein the zone of influence is within a radius of 4 feet about the injectors of the plurality of injectors.

11. The method of claim 4, wherein the solid foam matrix is contained within the zone of influence.

12. The method of claim 4, wherein the mass of the two-part polyurethane liquid is between 40-50 lbs. for each injector of the plurality of injectors.

13. A method for the reduction of liquefaction potential within soil of a stratum having a thickness and being located a distance below a surface, comprising:

providing a plurality of injectors, each injector of the plurality of injectors having a proximal portion and a distal portion, the distal portion having a perforated outer wall;

inserting the plurality of injectors within the soil;

locating the distal portion of each of the plurality of injectors within the stratum; and injecting a predetermined mass of a two-part polymer liquid down each of the plurality of injectors and into the stratum via the perforated outer wall of the distal portion so that the two-part polymer liquid permeates the stratum forming a tacky foam which cures to a solid foam matrix comprising particles of the soil within the stratum, the predetermined mass of the two-part polymer liquid being determined based on at least one or more soil properties of the stratum.

14. The method of claim 13, wherein injecting the predetermined mass of the two-part polymer liquid begins at an innermost injector and proceeds to an outermost injector to efficiently disperse the two-part polymer liquid.

15. The method of claim 13, wherein the plurality of injectors form a pattern across the surface of the foundation.

16. The method of claim 13, wherein the proximal portion of each of the plurality of injectors has a solid outer wall and a length generally corresponding to the distance below the surface.

17. The method of claim 13, wherein the distal portion has a length generally corresponding to the thickness of the loose stratum.

18. The method of claim 13, wherein a length of at least one of the distal portion or the proximal portion is 15 feet.

19. A method for the reduction of liquefaction potential within soil of a stratum located a distance below a foundation of a structure, the stratum having a thickness, comprising:

providing a plurality of injectors, each injector of the plurality of injectors having a hollow shape over a proximal portion and a distal portion, the proximal portion having a solid outer wall and a length generally corresponding to the distance below the foundation, the distal portion having a perforated outer wall and a length generally corresponding to the thickness of the stratum, the perforated outer wall comprising a plurality of openings;

locating the distal portion of each of the plurality of injectors within the stratum;

determining one or more soil properties of the stratum;

injecting a predetermined mass of a two-part polyurethane liquid down each of the plurality of injectors and into the stratum via the perforated outer wall of the distal portion, the predetermined mass of the two-part polyurethane liquid being based at last in part on the one or more soil properties;

permeating the stratum by the two-part polyurethane liquid injected while the two-part polyurethane liquid reacts forming a tacky foam, the tacky foam displacing water and binding to the soil within the stratum; and curing the tacky foam to form a solid foam matrix surrounding each of the plurality of injectors, each solid foam matrix having a hub structure parallel to the injector and coupled to a plurality of stacked spoke structures, each hub structure being reinforced by at least a portion of the distal portion of the injector respective to each hub structure.

20. The method of claim 19, wherein the one or more soil properties of the stratum include soil compactness, critical water content, shrinkage limit, or plastic limit.

* * * * *